US007705226B1

(12) United States Patent
Chang

(10) Patent No.: US 7,705,226 B1
(45) Date of Patent: Apr. 27, 2010

(54) OCTAVE-KEY TRANSFER-BAR PROTECTION DEVICE

(75) Inventor: I-Ping Chang, Taichung (TW)

(73) Assignee: King Dee Musical Instrument Corp., Taichung (TW)

( * ) Notice: Subject to any disclaimer, the term of this patent is extended or adjusted under 35 U.S.C. 154(b) by 0 days.

(21) Appl. No.: 12/406,123

(22) Filed: Mar. 18, 2009

(51) Int. Cl.
*G10D 7/08* (2006.01)

(52) U.S. Cl. ..... 84/385 R

(58) Field of Classification Search ..... 84/385 R, 84/380 R, 385 A, 387 R
See application file for complete search history.

(56) References Cited

U.S. PATENT DOCUMENTS 2,425,795 A * 8/1947 Gillespie ..... 84/385 R

* cited by examiner

*Primary Examiner*—Kimberly R Lockett
(74) *Attorney, Agent, or Firm*—Ching Ling Huang

(57) ABSTRACT

The present invention discloses an octave-key transfer-bar protection device, which is installed on a saxophone to protect an octave-key transfer-bar on the saxophone, and which comprises a structure body, and a collision-protection bar arranged on the structure body and encircling an accommodation space. The structure body is fixed to the external surface of the saxophone. The octave-key transfer-bar is arranged inside the accommodation space and encircled by the collision-protection bar. The collision-protection bar can protect the octave-key transfer-bar from being deformed by collision. Thus, the performer can correctly lower or raise the gamut via the octave-key transfer-bar.

3 Claims, 4 Drawing Sheets

OCTAVE-KEY TRANSFER-BAR PROTECTION DEVICE

FIELD OF THE INVENTION

The present invention relates to a saxophone, particularly to an octave-key transfer-bar protection device for the saxophone.

BACKGROUND OF THE INVENTION

The saxophone is a wind instrument having a peculiar tone color, which can be played solo and is widely used by individual performer. Refer to FIG. 1. To increase the gamut, a conventional saxophone 1 has an octave-key transfer bar 2 to trigger an octave valve 3 and control the resonant frequency of the saxophone 1 by opening and closing the octave valve 3, whereby the gamut of the saxophone 1 is lowered or raised. Thus, the performer has a wider gamut to present the music.

In the conventional saxophone 1, the octave-key transfer bar 2 is arranged on the surface 4 thereof. When the performer presses a button 5, the button 5 actuates a link bar 6 to move the octave-key transfer bar 2 and open or close the octave valve 3. Thus is varied the resonant frequency of the saxophone 1.

The octave-key transfer bar 2 may be deformed by collision during performing or delivering, which will vary the displacement of the octave-key transfer bar 2 actuated by the link bar 6, the extent of opening or closing the octave valve 3, and the extent of increasing or decreasing the frequency of the saxophone 1 can not be achieved. Consequently, the performer cannot present the exact pitches but has an imperfect performance.

SUMMARY OF THE INVENTION

The primary objective of the present invention is to provide a protection device to prevent the octave-key transfer bar from being deformed by collision.

The present invention proposes an octave-key transfer-bar protection device, which applies to a saxophone having an octave-key transfer-bar. The protection device of the present invention comprises a structure body and a collision-protection bar. The structure body is fixed to the saxophone. The collision-protection bar is arranged on the structure body and encircles an accommodation space, and the octave-key transfer-bar is arranged inside the accommodation space and encircled by the collision-protection bar.

The collision-protection bar encircling the octave-key transfer-bar forms a protection structure to prevent the octave-key transfer-bar from being directly impacted by external force. Thus, the octave-key transfer-bar is guaranteed to function normally, and the performer can correctly lower or raise the gamut via the octave-key transfer-bar.

DETAILED DESCRIPTION OF THE PREFERRED EMBODIMENTS

Below, the embodiments are described in detail in cooperation with the drawings to make easily understood the objectives, characteristics, and accomplishments of the present invention.

Figure 1:
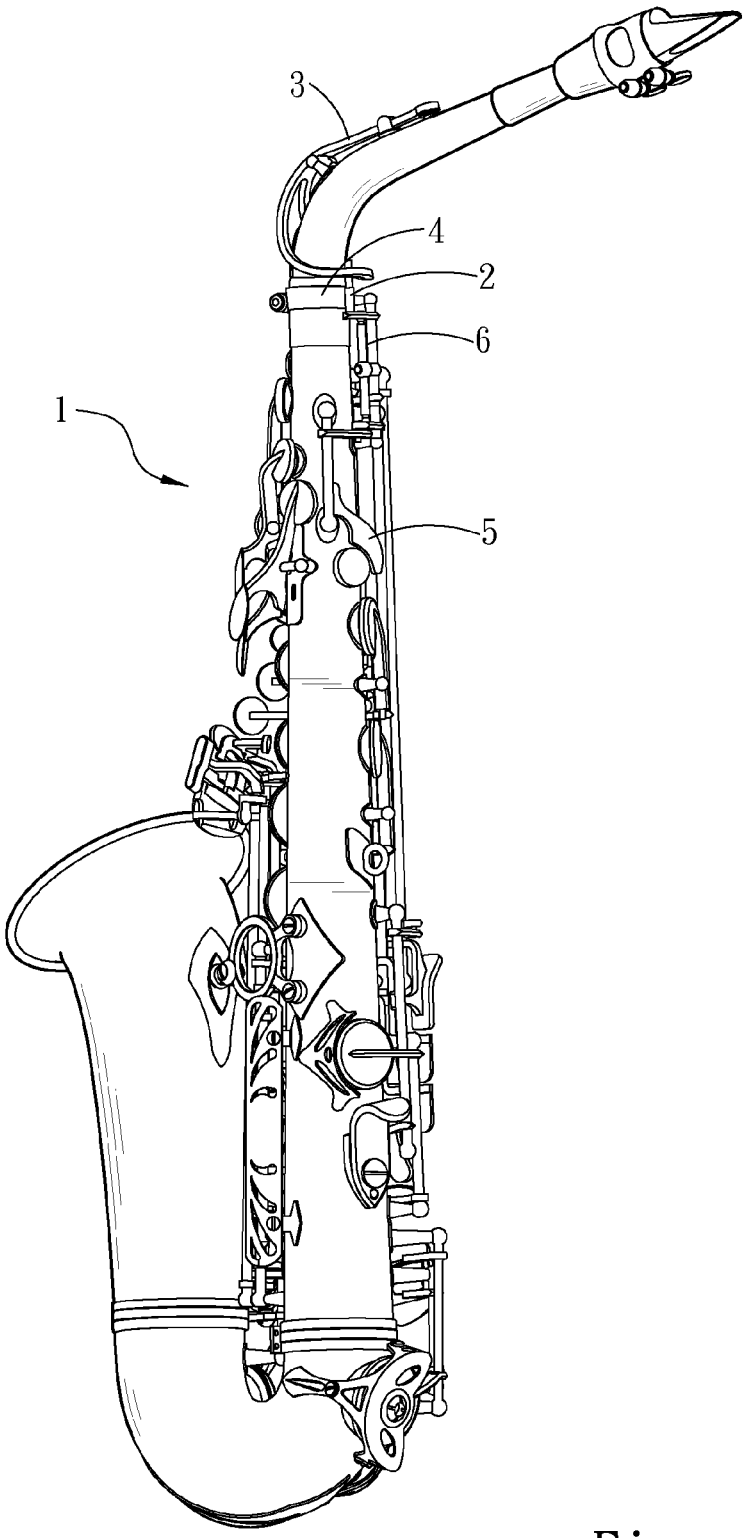
Fig. 1 PRIOR ART
FIG. 1 is a diagram schematically showing the structure of a conventional saxophone.
Figure 2:
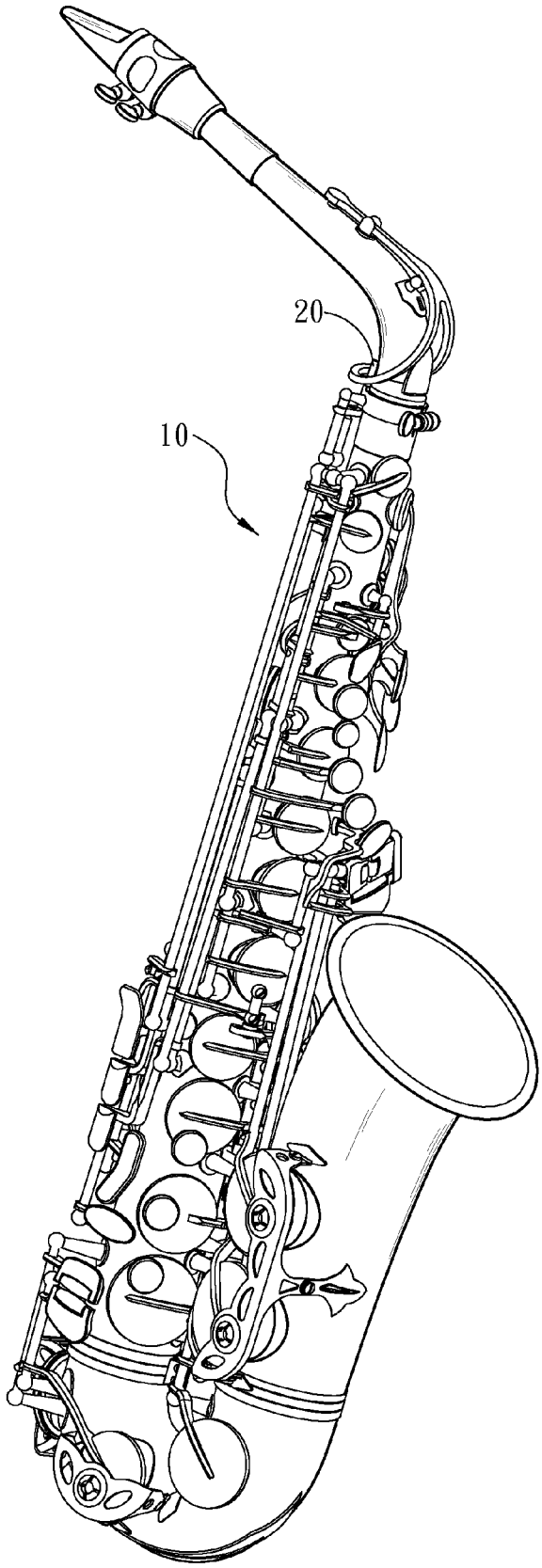
FIG. 2 is a diagram schematically showing the structure of a saxophone using the present invention.

Refer to FIG. 2. The present invention discloses an octave-key transfer-bar protection device applying to a saxophone 10. The saxophone 10 has an octave-key transfer-bar 20 used to modulate the gamut, wherein the gamut is usually lowered or raised by an octave. The performer will adjust the octave-key transfer-bar 20 according to the requirement for gamut.

Figure 3:
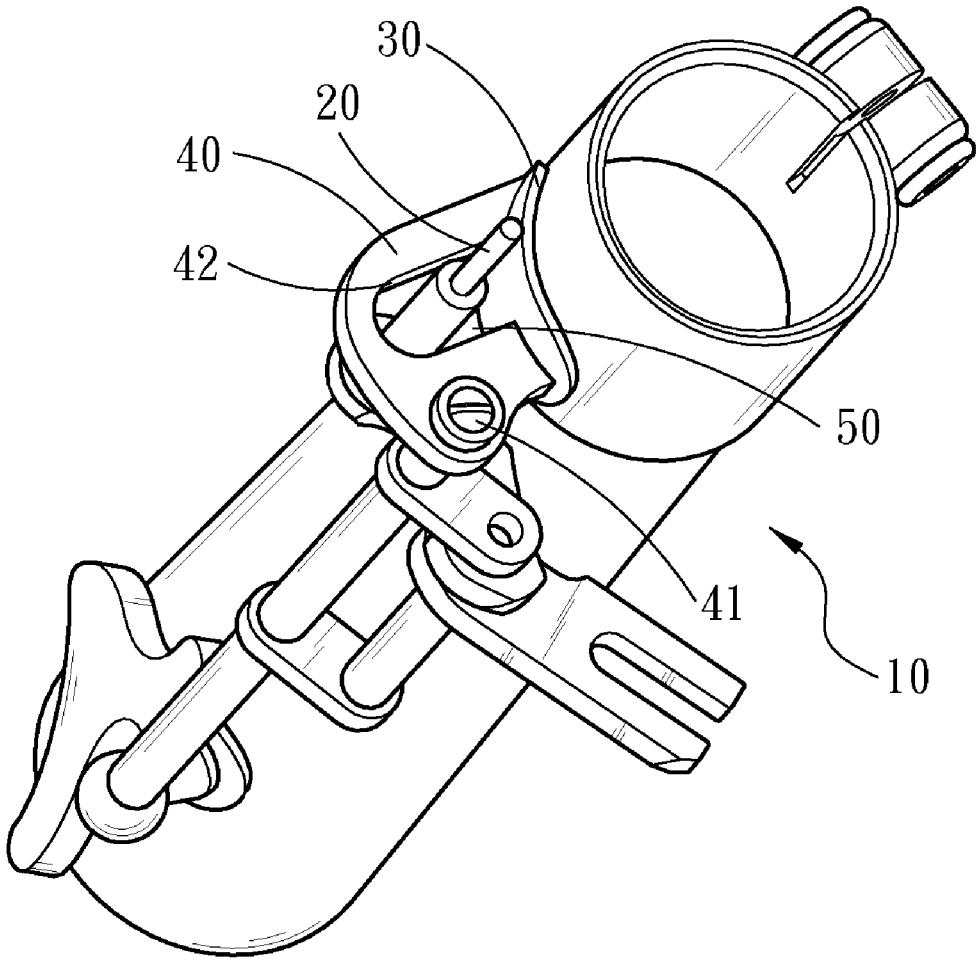
FIG. 3 is a diagram schematically showing the structure of an octave-key transfer-bar protection device according to the present invention.

Refer to FIG. 3. The protection device of the present invention comprises a structure body 30 and a collision-protection bar 40. The structure body 30 is fixedly installed on the saxophone 10, and the collision-protection bar 40 is arranged on the structure body 30. The collision-protection bar 40 encircles an accommodation space 50, and the octave-key transfer-bar 20 is arranged inside the accommodation space 50 and encircled by the collision-protection bar 40. Thereby, the collision-protection bar 40 can protect the octave-key transfer-bar 20 from being deformed by collision.

Figure 4:
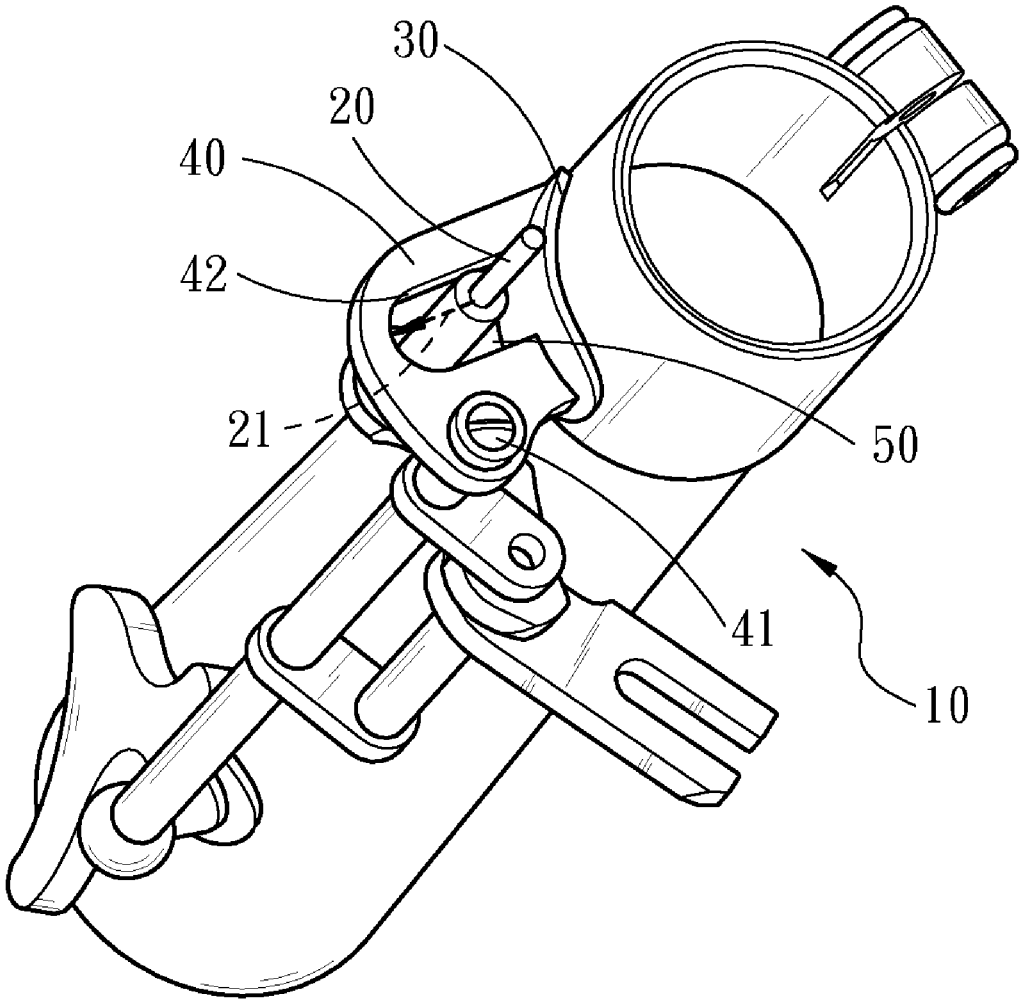
FIG. 4 is a diagram schematically showing the operation of an octave-key transfer-bar protection device according to the present invention.

Refer to FIG. 4. In the present invention, the octave-key transfer-bar 20 can be operated to swing back and forth to form a motion track 21. In the present invention, the collision-protection bar 40 encircles the motion track 21 to form the accommodation space 50, whereby the octave-key transfer-bar 20 is protected. The collision-protection bar 40 may further have a pivotal point 41. The octave-key transfer-bar 20 is pivotally coupled to the pivotal point 41, whereby the octave-key transfer-bar 20 can swing back and forth. In the present invention, the collision-protection bar 40 may be made of a flat-plate shape, and a slot 42 is fabricated on the collision-protection bar 40 to form the accommodation space 50.

In conclusion, the present invention provides a protection device to protect the octave-key transfer-bar 20 from being deformed or damaged by collision. Thus, the saxophone performer can operate the octave-key transfer-bar 20 to have a correct displacement, whereby he can accurately lower or raise the gamut to attain the desired pitches.

The embodiments described above are only to exemplify the present invention but not to limit the scope of the present invention. Any equivalent modification or variation according to the spirit of the present invention is to be also included within the scope of the present invention.

What is claimed is:

1. An octave-key transfer-bar protection device, which is installed on a saxophone having an octave-key transfer-bar, comprising:

a structure body fixedly installed on said saxophone; and a collision-protection bar arranged on said structure body and encircling an accommodation space with said octave-key transfer-bar arranged inside said accommodation space;

wherein said octave-key transfer-bar is operated to swing back and forth to form a motion track, and said collision-protection bar encircles said motion track to form said accommodation space.

2. The octave-key transfer-bar protection device according to claim 1, wherein said collision-protection bar has a pivotal point; said octave-key transfer-bar is pivotally coupled to said pivotal point.

3. The octave-key transfer-bar protection device according to claim 1, wherein said collision-protection bar is made of a flat-plate shape; a slot is fabricated on said collision-protection bar to form said accommodation space.

* * * * *